US007513501B2

(12) United States Patent
Vernetti et al.

(10) Patent No.: US 7,513,501 B2
(45) Date of Patent: Apr. 7, 2009

(54) PAPER FEEDING DEVICE FOR DOT PRINTERS FOR EXAMPLE INK JET PHOTOGRAPHIC PRINTERS

(75) Inventors: Claudio Vernetti, Ivrea (IT); Riccardo Nicolari, Ivrea (IT); Fabio Dondi, Ivrea (IT); Mauro Mondino, Ivrea (IT); Mario Manzone, Ivrea (IT)

(73) Assignee: Telecom Italia S.p.A., Milan (IT)

( * ) Notice: Subject to any disclaimer, the term of this patent is extended or adjusted under 35 U.S.C. 154(b) by 587 days.

(21) Appl. No.: 10/510,442

(22) PCT Filed: Apr. 8, 2003

(86) PCT No.: PCT/IT03/00215

§ 371 (c)(1),
(2), (4) Date: Oct. 7, 2004

(87) PCT Pub. No.: WO03/084761

PCT Pub. Date: Oct. 16, 2003

(65) Prior Publication Data

US 2005/0179191 A1 Aug. 18, 2005

(30) Foreign Application Priority Data

Apr. 8, 2002 (IT) ..... TO2002A0304

(51) Int. Cl.
*B65H 5/16* (2006.01)
*B65H 5/00* (2006.01)

(52) U.S. Cl. ..... 271/270; 271/114; 271/10.02; 271/10.03; 271/10.09; 271/10.13

(58) Field of Classification Search ..... 271/10.09, 271/10.11, 10.12, 270, 272, 275, 10.01, 114, 271/10.02, 10.03, 10.04, 10.13; 347/104; 74/405, 395, 397; 400/582, 578, 624, 625
See application file for complete search history.

(56) References Cited

U.S. PATENT DOCUMENTS

| | | | | |
|---|---|---|---|---|
| 4,090,410 | A * | 5/1978 | Nakamura | 74/414 |
| 4,630,949 | A | 12/1986 | Boella et al. | |
| 4,789,259 | A | 12/1988 | Katayanagi | |
| 4,909,649 | A * | 3/1990 | Okunomiya | 400/583.4 |
| 5,043,771 | A * | 8/1991 | Shibata et al. | 399/396 |
| 5,055,885 | A * | 10/1991 | Yoshikado et al. | 399/401 |
| 5,354,136 | A * | 10/1994 | Takizawa et al. | 400/185 |
| 5,676,365 | A * | 10/1997 | Pittelkow et al. | 271/125 |

(Continued)

FOREIGN PATENT DOCUMENTS

| | | |
|---|---|---|
| JP | 58 131084 A | 8/1983 |
| JP | 63 170054 A | 7/1988 |

*Primary Examiner*—Patrick H Mackey
*Assistant Examiner*—Luis Gonzalez
(74) *Attorney, Agent, or Firm*—Venable LLP; Robert Kinberg; Steven J. Schwarz

(57) ABSTRACT

Paper feeding device (33) for ink jet photographic printers, comprising a paper feeding motor (83) for preparing and feeding sheets to be printed (26) for printing. The feeding device (33) is characterized in that it comprises a changeover mechanism (149) disposed downstream of the paper feeding motor (83) and suitable for activation in response to predetermined operating conditions of the printer for moving a sheet (26) at high speed in the preparation stage and at high resolution in association with printing.

20 Claims, 5 Drawing Sheets

U.S. PATENT DOCUMENTS 5,974,283 A * 10/1999 Cho ..... 399/75
6,135,442 A * 10/2000 Hirata et al. ..... 271/116
6,257,692 B1 * 7/2001 Yokoi et al. ..... 347/16
6,446,954 B1 * 9/2002 Lim et al. ..... 271/10.04
6,650,436 B1 * 11/2003 Hamamoto et al. ..... 358/1.9
6,672,581 B2 * 1/2004 Lee et al. ..... 271/164

* cited by examiner

PAPER FEEDING DEVICE FOR DOT PRINTERS FOR EXAMPLE INK JET PHOTOGRAPHIC PRINTERS

This is a U.S. National Phase Application Under 35 USC 371 and applicant herewith claims the benefit of priority of PCT/IT03/00215 filed on Apr. 8, 2003, which was published Under PCT Article 21(2) in English, and of Application No. TO2002A000304 filed in Italy on Apr. 8, 2002. The contents of the applications are incorporated by reference herein.

TECHNICAL FIELD

This invention relates to a paper feeding device for dot printers, for example for an ink jet photographic printer.

More specifically, the invention relates to a paper feeding device for a compact dot printer, for example for an ink jet photographic printer, according to the introductory part of claim 1.

BRIEF DESCRIPTION OF THE STATE OF THE ART

In printers offering high quality printing, the sheet to be printed is subject to complex movements, often in opposing directions in the preparatory stage and in the printing stage true and proper. The feeding requirements for the two stages are completely different and require suitable linkages to produce them.

SUMMARY DESCRIPTION OF THE INVENTION

The object of this invention is to produce a paper feeding device for a dot photographic printer that is reliable, fast and inexpensive.

This object is attained by the device of the invention according to the characteristic parts of the claims 1, and/or 20.

BRIEF DESCRIPTION OF THE DRAWINGS

The characteristics of the invention will become clear from the description that follows, provided merely by way of non-restrictive example, with the aid of the accompanying drawings, in which.

DETAILED DESCRIPTION OF THE INVENTION

Figure 1:
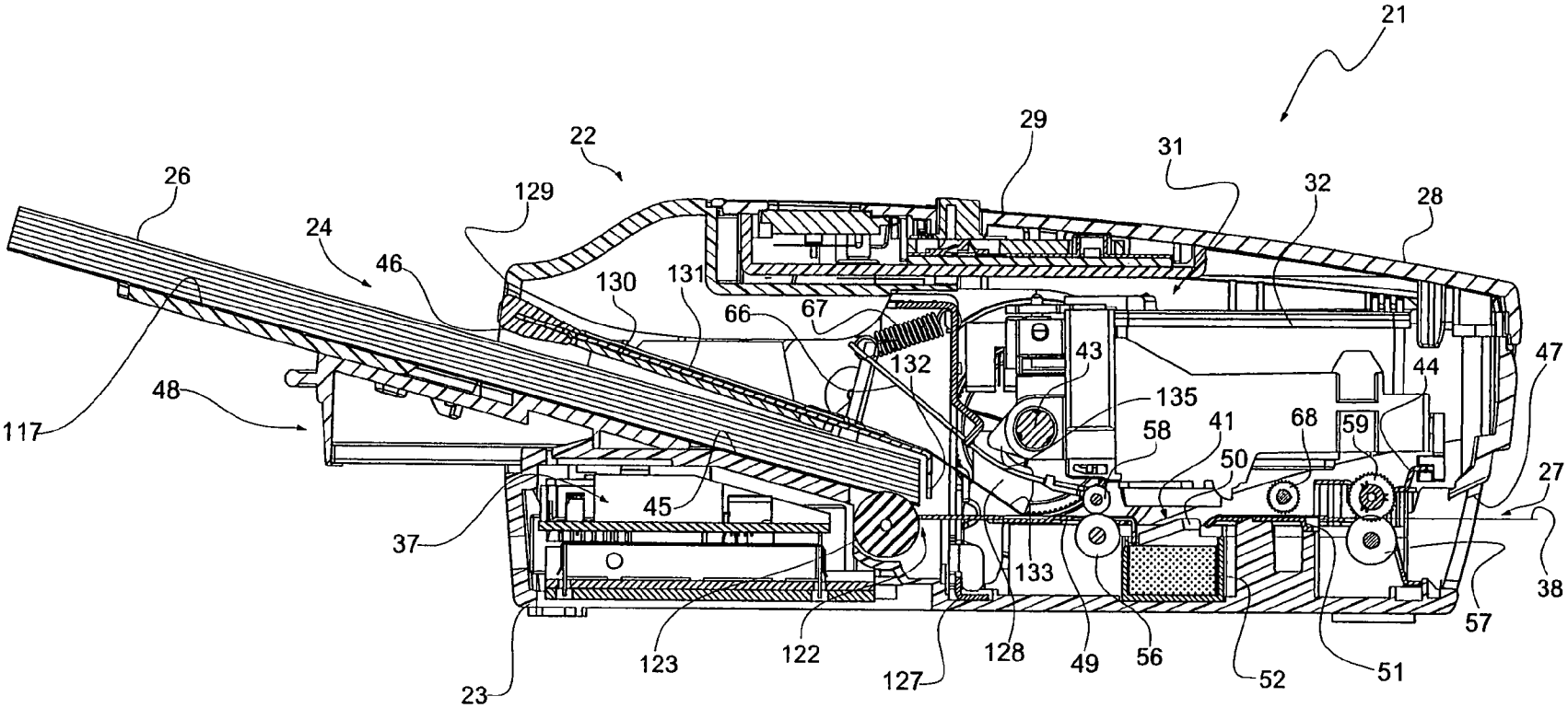
FIG. 1 represents a schematic sectioned view of a printer with a paper feeding device according to the invention.
Figure 2:
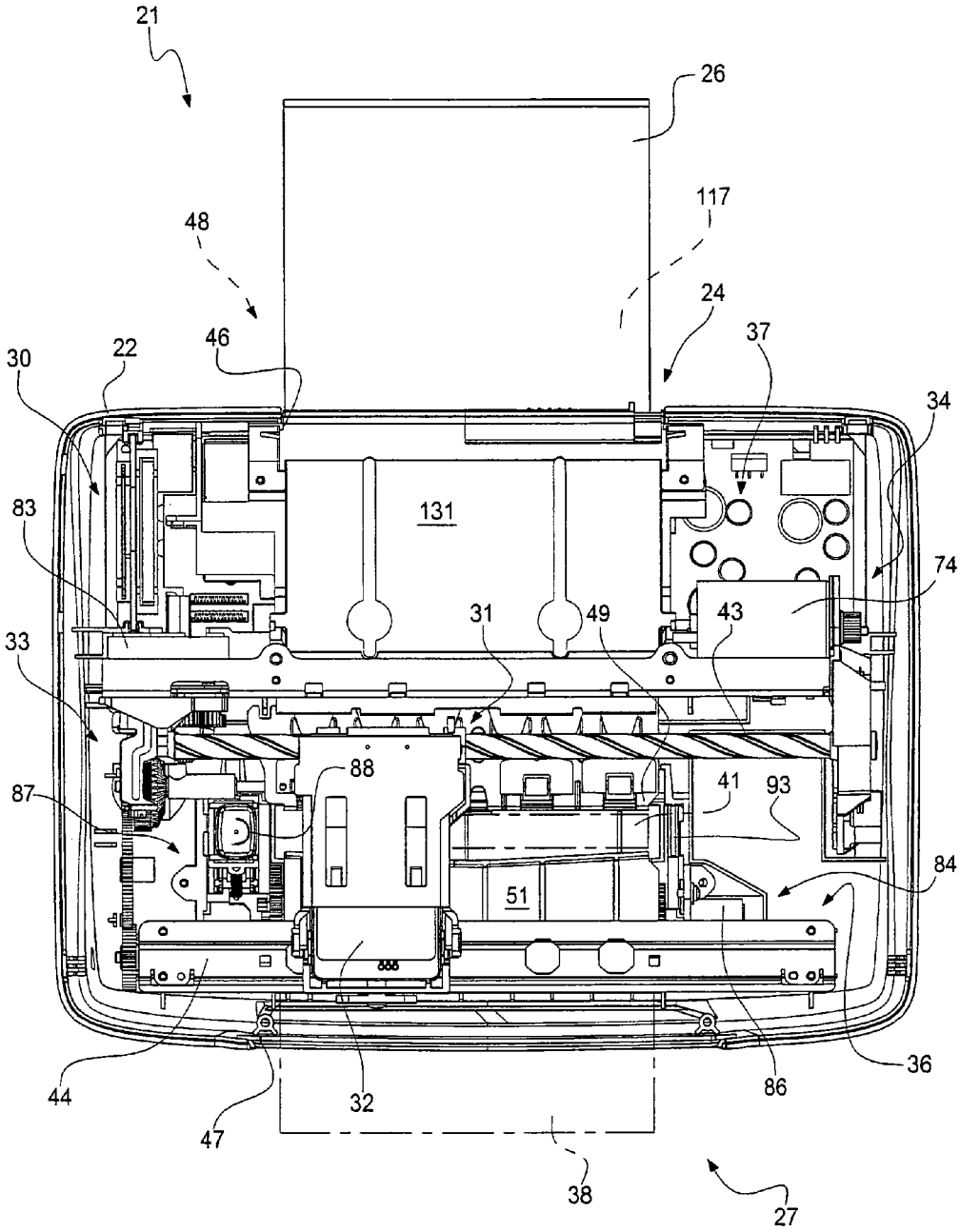
FIG. 2 is a plan view of internal parts of printer of FIG. 1.

Depicted with 21 in FIGS. 1 and 2 is an ink jet dot photographic printer, comprising a casing 22 with a base 23, an entrance section 24, to the rear, for sheets to be printed 26 and an exit section 27, to the front, of the type described in patent application TO 0002A000195 filed on 8 Mar. 2002, on behalf of the Applicant and to which reference will be made for the relative details.

The printer 21 comprises a carriage 31 movable transversally, a printhead 32 borne by the carriage 31, a feeding device 33 for the sheets 26, a transport device 34 for the carriage 31, a service device 36 and an electronic unit 37.

The printer 21 is suitable for printing photographic pictures on sheets 26 made of paper or cards on a movement plane 38, parallel and adjacent to the base 23. The head 32 is ink jet type, colour, with nozzles arranged along the bottom defining a printing area 41 on the plane 38, adjacent to the middle part of the printer.

The printer 21, a compact one, is of flattened parallelepiped shape and the carriage 31 is guided by a worm screw shaft 43 and by a profile section 44 located, respectively, behind and in front of the printing area 41. The entrance section 24 defines a rear aperture 46 and a seat, inclined with respect to the base and which extends to an inclined plane 45 in a middle zone of the printer. The section 27 includes a front aperture 47. A tray 48 is housed in the section 24 having a support function for a pack of sheets 26, when it is open.

The movement plane 38 is defined by a rear guide plate 49 (FIGS. 1, 2 and 3) and by a front guide plate 51, separated from one another and arranged, in plan view, in front of and behind the printing area 41.

The feeding device 33 comprises first and second motor rollers 56 and 57, gripping rollers 58 and tooth disks 59 arranged respectively behind and in front of the printing area 41 and a step type paper feeding motor 83.

Provided behind the printing area 41 (FIGS. 1, 2, and 3) are two optical sensors 60 and 61 suitable for switching upon the passage and positioning of a sheet 26. The sensor 60 is a direct type and is arranged behind the rollers 56. The sensor 61 is on the other hand controlled by an appendage 62 having one end with inclining edges arranged in front of the rollers 56, interfering lightly with the plane 38.

The motor rollers 56 and 57 are keyed on to respective shafts 63 and 64 connected cinematically together through a train of gears 69 and with the possibility of being connected in rotation with the paper feeding motor 83. The rollers 58 are mounted on axes borne by a contrast plate 66 above the plate 49 and urged by a spring 67 to push the rollers 58 against the rollers 56.

The tooth disks 59 are mounted on respective shafts borne by the profile section 44 (FIG. 1) lightly interfering with the motor rollers 57. Another two tooth disks 68 are suitable for rotating idly a short distance from the front plate 51, with the function of guiding and contrasting the sheets 26.

Figure 7:
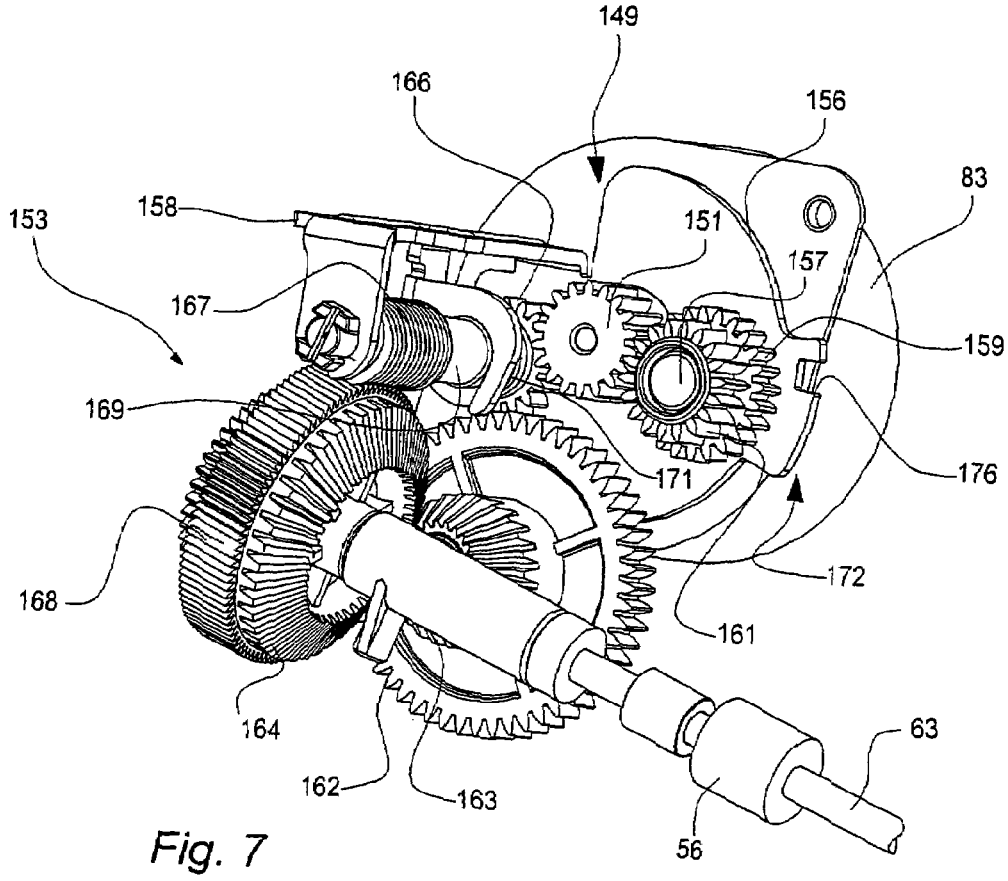
FIG. 7 represents some of the details of FIG. 4 in another working configuration.

The transport device 34 (FIGS. 2 and 7) includes the worm screw shaft 43, a guide screw mounted on the carriage 31 and a transport motor 74. The motor 74 is coupled with the shaft 43 through a pinion 76, a coding wheel 77 and a toothed belt 78. The positions of the carriage 31 are detected by a linear encoder comprising a transparent strip 81 with coding bars, readable by a sensor 82 mounted on the carriage 31.

The services device 36 (FIGS. 2 and 13) comprises a cleaning station 84 with a rubber blade 93 and service motor 86, a covering station 87 with a cap 88 arranged on opposing sides beside the movement plane 38 and interconnecting elements 89.

The blade 93 is movable to a working position in which it interferes with the trajectory of the head for cleaning the nozzles. The cap 88 may be moved to a closed position for the nozzles when the head 32 is in the rest position on the left of the movement plane 38.

The tray 48 has an inclined, upper plane 117, which, when the tray is open, is co-planar with the plane 45 for receiving the pack of sheets 26.

The feeding device 33 comprises a picking mechanism 122 (FIGS. 1, 3 and 4) for the pack of sheets 26, which is also motorized by the motor 83. The mechanism includes a picking roller 123 that may be engaged by the last of the sheets 26 lying on the tray 48 and a clutch 124, normally open, between the motor 83 and the picking roller 123. The clutch 124 is connected to the roller 123 by means of gears 125 and is in connection with the first motor rollers 56 through a train of gears 126 arranged below the movement plane 38.

Figure 6:
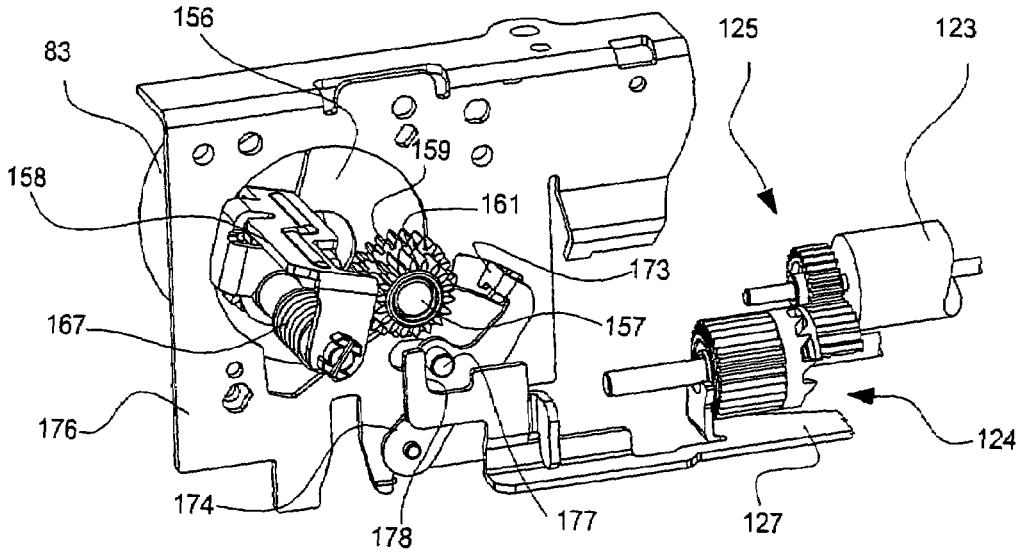
FIG. 6 is a front perspective view of some of the details of FIG. 5.

The clutch 124 is driven through a fork 134 by a transversal slide 127 (FIG. 6) arranged low down, behind the shaft 43. In particular, the slide 127 at one end has a tab 128 suitable for being engaged by an appendage 135 of the carriage 31 in a maximum overtravel position which, in plan view, is on the right of the cleaning station 84. The clutch 124 is normally open and keeps the roller 123 disconnected from the motor 83 and is closed by the slide 127 when the carriage 31 is in the maximum overtravel position.

The printer 21 (FIGS. 1 and 2) also comprises a slot 129 above the aperture 46, a plate 131 with a rear edge adjacent to the slot 129 and a spring plate 130. A front edge of the plate 131 defines a tab 132 arranged slightly in front of the picking roller 123, providing a contrast to the front edges of the sheets 26. The spring plate 130 protrudes into the section 24 and, in use, urges the pack of sheets 26 against the roller 123.

Figure 3:
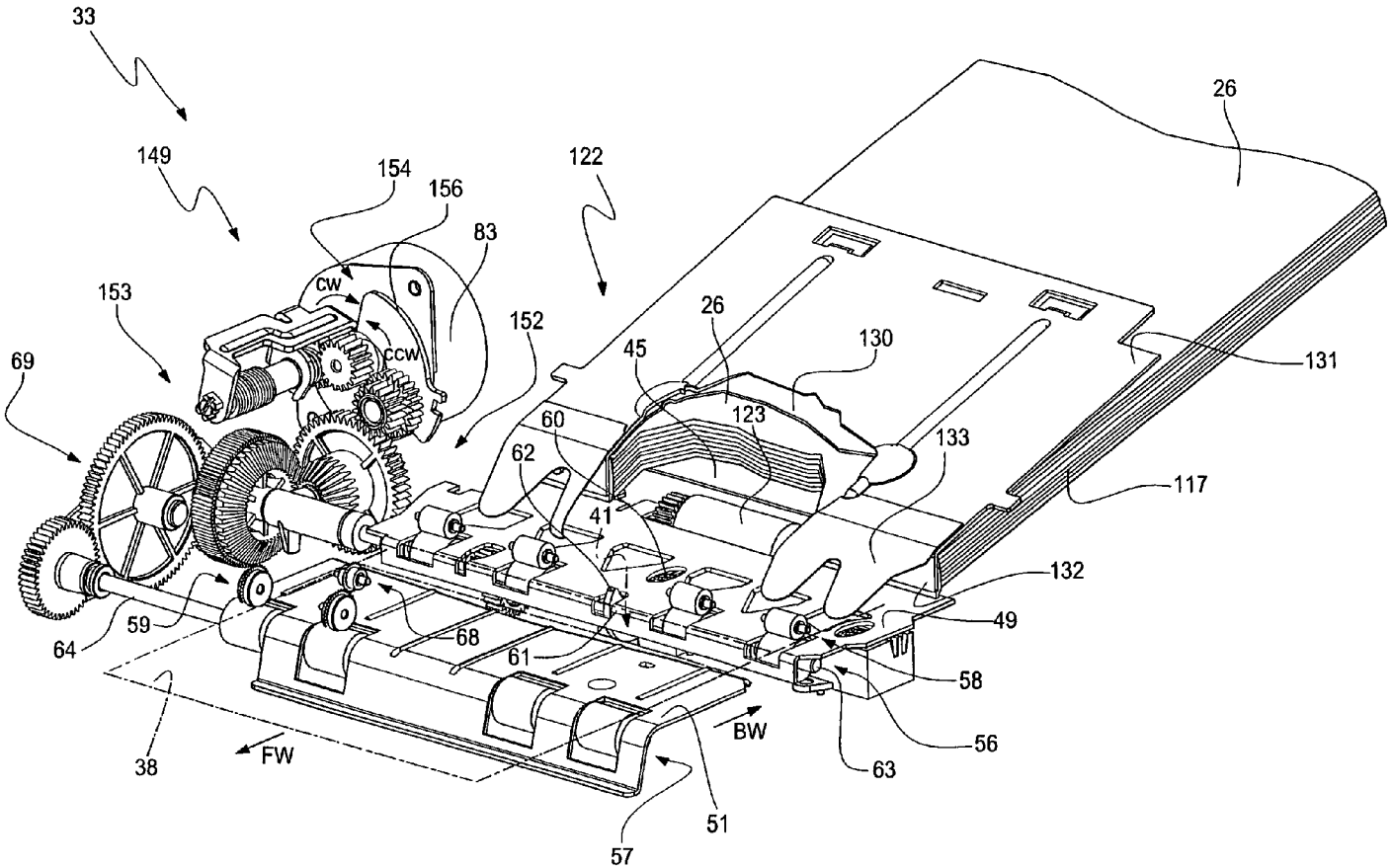
FIG. 3 represents a front perspective view of the paper feeding device according to the invention.
Figure 4:
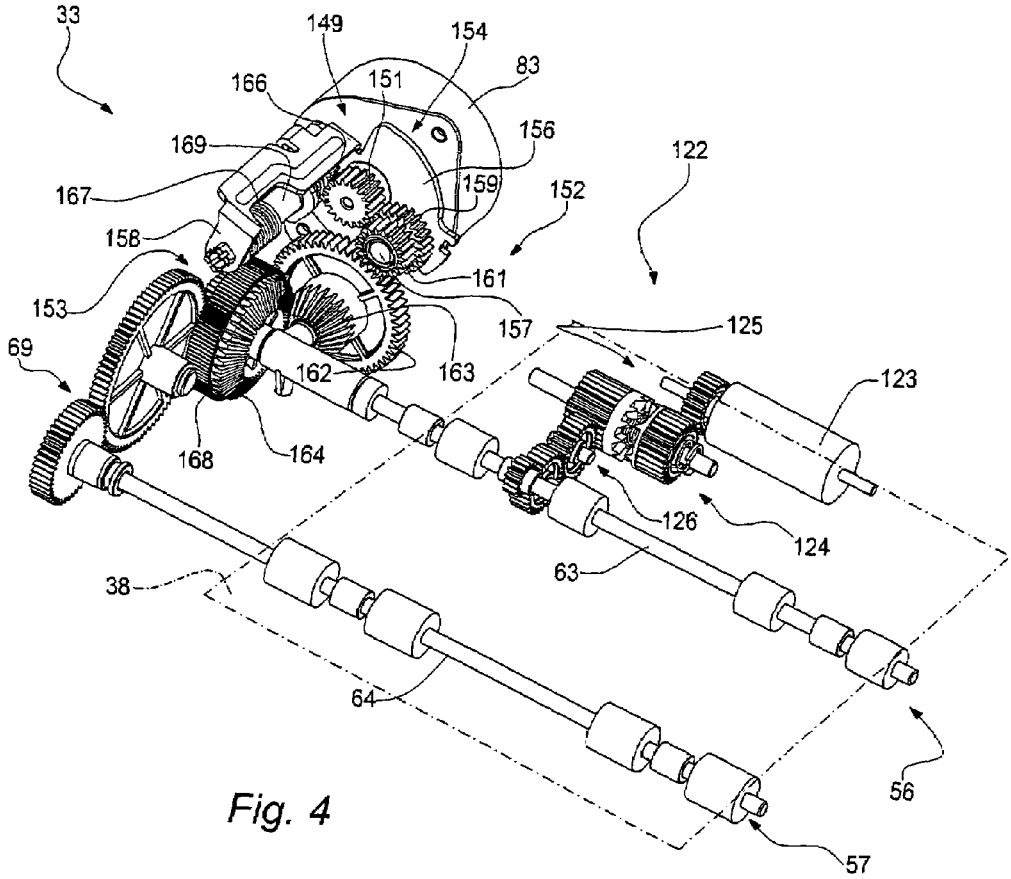
FIG. 4 represents a front perspective view of some details of the device of the invention in a given working configuration.

The plate 131 supports, adjacent to the tab 132, a deflector 133, made of Mylar, inclined towards the plate 49 and with a front edge resting on the plate, slightly upstream of the sensor 60 (see FIG. 3). The deflector is arranged for guiding the exchange of sheets 26 between the tray 48 and the movement plane 38 in association with picking and between the plane 38 and the plate 131 in association with preparation for printing.

In accordance with the invention, the sheet feeding device 33 comprises a changeover mechanism 149. This mechanism may be actuated in response to predetermined working conditions of the printer 21 for moving the sheets 26 at high speed in the picking and print preparation stages and at high resolution in the printing stage.

More specifically, the motor 83 (FIGS. 3 and 4) has an output with a motor pinion 151 having clockwise (CW) and counter-clockwise (CCW) rotating possibilities. The feeding device 33 comprises a first kinematic linkage 152, a second kinematic linkage 153 and an actuating member 154 for the changeover mechanism 149, servo dependent on the direction of rotation of the pinion 151.

The first kinematic linkage 152 produces the high speed movements of the sheets for picking and print preparation, whereas the second chain 153 produces their high resolution movements.

The actuating member 154 comprises a plate 156 suitable for oscillating on the axis of the motor 83 and provided with a pin 157 and a tab 158 with one L-shaped end, the function of which is to bear the components actuating the chains 152 and 153.

The kinematic linkage 152 comprises an intermediate tooth wheel 159 and a coupling tooth wheel 161 rotating about the pin 157, a flat tooth wheel 162 and a pair of conical tooth wheels 163 and 164. The tooth wheels 159 and 161 are integral with one another and the tooth wheel 162 is integral with the conical tooth wheel 163, whereas the conical tooth wheel 164 is connected in rotation with the shaft 63 of the first motor rollers 56.

In the kinematic linkage 152, the tooth wheel 161 acts as the actuating component and the tooth wheel 159 is in meshing engagement with the pinion 151. The tooth wheel 161 is suitable for meshing with the tooth wheel 162 for setting the chain in operation, in a configuration of the plate 156 rotated clockwise in FIGS. 3 and 4.

The kinematic linkage 153 comprises an intermediate tooth wheel 166, a worm screw 167 and a helical wheel 168. The intermediate tooth wheel 166 and the worm screw 167 are keyed on an axis 169 rotating between the plate 156 and the L-shaped end of the tab 158, whereas the helical wheel 168 is integral with the conical tooth wheel 164. A spiral spring 171 (see FIG. 7) operates between the tooth wheel 166 and an intermediate fold in the tab 158, for a clutching action on the whole consisting of the tooth wheel 166 and the worm screw 167.

In the kinematic linkage 153 the worm screw 167 acts as the actuating component. The tooth wheel 166 meshes with the pinion 151 and the worm screw 167 is suitable for meshing with the helical wheel 168 to set into operation the kinematic linkage 153 in a configuration of the plate 156 rotated counter-clockwise in FIG. 7.

With this structure, for a given direction of rotation of the motor 83, the two kinematic linkages 152 and 153 tend to make the motor rollers 56 and 57 rotate in opposite directions. Thus, the chain 152 is suitable for moving the sheet (26) forward (FW) for one clockwise (CW) rotation of the motor 83, whilst a similar forward (FW) movement of the sheet (26) by the chain 154 requires a counter-clockwise (CCW) rotation of the motor 83.

The transmission ratios of the two kinematic linkages 152 and 153 are significantly different. Purely by way of example, with a 24-step motor 83, the displacement that may be obtained by the chain 152 is of 177 steps per inch whereas that obtainable from the chain 153 is 2,400 steps per inch. The switching speed of the motor 83 is imposed by the electronic unit 37 in relation to the specific kinematic requirements of preparation and printing.

The intermediate tooth wheels 159 and 166 (FIGS. 3, 4 and 7) oppose the rotation of the pinion 151 with resistances that angularly urge the actuating member 154 in the same direction of rotation as the pinion and which increase with the clutching action of the spring 171.

In particular, a clockwise (CW) rotation of the pinion 151 induces the plate 156 to mesh the tooth wheel 161 with the tooth wheel 162 and keep it meshing. A counter-clockwise (CCW) rotation of the pinion 151, on the other hand, induces the plate 156 to mesh the worm screw 167 with the helical wheel 168 and maintain this engagement.

According to the invention, a blocking group is also provided to make inoperative servo dependency of the actuating member 154 on the direction of rotation of the motor 83 and a control group to render the blocking group inoperative.

The control group is servo driven by the carriage 31 to render inoperative the blocking group in a working position of the carriage outside the printing area 41.

The blocking group also comprises storing elements for memorizing a given setting condition.

To advantage, the blocking group comprises a cam profile 172 of the plate 156 and a stopping and storing lever 174 with a tab 173 which in turn collaborates with the cam profile 172. The control group comprises the slide 127 which is suitable for interacting with the lever 174 for controlling position of the actuating member 154.

Figure 5:
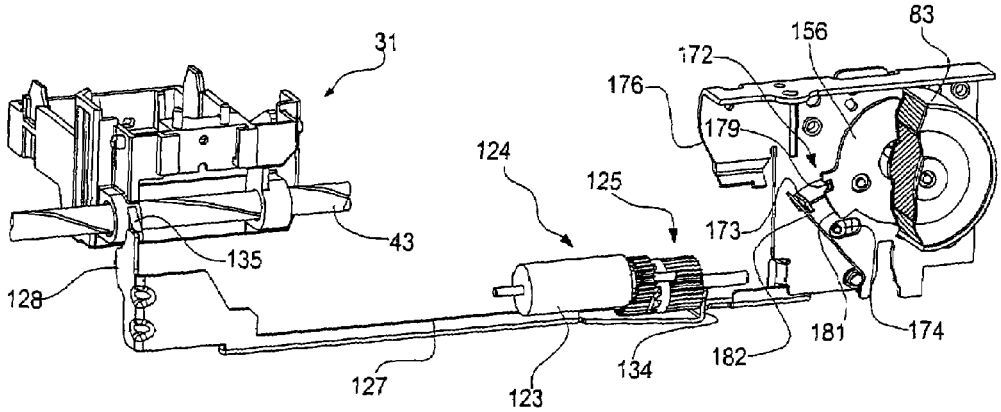
FIG. 5 shows a front perspective view of other details of the feeding device of the invention.

In detail, a frame 176 upon which is mounted the motor 83 slidingly bears the slide 127 in an end section opposite that with the tab 128. The lever 174 is fulcrum-mounted on the frame 176 and includes a pin 177 suitable for collaborating with a shoulder 178 made in the end of the slide 127 adjacent to the sliding section. The cam profile 172 defines a recess 179 and a sector 181, adjacent to the recess 179, having a gradient gradually increasing in the counter-clockwise direction. The recess 179 may couple with the tab 173 (FIG. 5) in the configuration of the plate 156 of FIGS. 3 and 4 in which the kinematic linkage 152 is in operation.

A pin spring 182 between the lever 174 and the slide 127 urges the lever 174 against the cam profile 172 and, through the pin 177 and the shoulder 178 holds the slide 127 in the rest position at end of travel, on the left in plan view. In turn, the slide 127 can withdraw the lever 174 from the profile 172 by means of the pin 177 and the shoulder 178. This can be done for a given displacement to the right of the slide 127 that the appendage 135 of the carriage 31 can effect in an intermediate overtravel position, to the right of the blade 93.

The slide 127 with the tab 128 and the shoulder 178 define the control group under servo control of the carriage 31 and the sector 181 represents the memory element of the control group.

The mode of operating of the printer 21 is as follows:

When idle, the pack of sheets 26 is arranged on the plane 117 of the tray 48, engaged by the roller 123 through the action of the plate 130. The carriage 31 (FIG. 2) is on the left of the movement plane 38 on the station 87 with the nozzles of the head 32 covered by the cap 88.

The electronic unit 37 initializes the printer 21 and the relative mechanisms by activating the motors 74 and 86. The cap 88 is lowered and the carriage 31 is moved to the right in correspondence with the cleaning station 84. Then a known type of cycle is effected with displacements of the carriage above the blade 93 for cleaning of the nozzles and emissions of ink and the carriage is stopped at the end-of-stroke-position on the right.

Then the motor 83 is activated for a clockwise rotation of the pinion 151, with reference to FIG. 3, with meshing of the tooth wheels 161 and 162 and activation of the chain 152 for a counter-clockwise rotation, at high speed of the motor rollers 56 and 57 so as to move a sheet (26) that may be present forward (FW), until it is fully ejected through the aperture 47.

The printer 21 is now ready to start a stage, at high speed, of preparation and a stage, at high resolution, in association with printing.

The preparation stage includes in sequence sub-stages of feeding, of retracting and of positioning of the sheet 26.

The feeding sub-stage is associated with picking of the sheet from the pack with displacement from the plane 117 and along the plane 38 in a direction consistent with the direction of printing (FW). The retracting sub-stage includes displacement of the sheet (26) in the opposite direction (BW) to the direction of printing (FW) on the plane 38 and the plate 131. Finally the positioning sub-stage includes displacement of the sheet 26 in a direction consistent with the direction of printing (FW) on the plate 131 and until the leading edge stops immediately behind the printing area 41.

In detail, for picking, the motor 74 is activated by bringing the carriage 31 to a maximum overtravel position, on the right of the blade 93. Here, through the appendage 135 and the tab 128, the carriage 31 moves the slide 127 by about 5 mm to the right, closing the clutch 124 though the fork 134 and removing the tab 173 of the storing lever 174 from the cam profile 172.

The electronic unit 37 now activates the motor 83 for a clockwise rotation (CW) of the pinion 151, with reference to FIG. 3, with meshing of the tooth wheels 161 and 162, activation of the chain 152 and counter-clockwise rotation, at high speed, of the roller 123 and of the motor rollers 56 and 57. The motor 83 is switch at an average speed, for example of 300 pps, suitable for optimal picking.

The roller 123 picks the last sheet 26 and drags it forward (FW), displacing the deflector 133 and bringing the sheet into grip with the rollers 56, 58, until the front edge of the sheet moves the appendage 62, causing the controlled sensor 61 to switch. The electronic unit 37 increases the switching speed of the motor 83, for instance to 600 pps, for high speed displacement of the sheet 26.

In the feeding sub-stage, the motor rollers 56 and then the motor rollers 57 continue the forward (FW) movement of the sheet 26 with a partial traversing of the front aperture 47 until the direct sensor 60 is switched upon passage of the rear edge of the sheet.

The electronic unit 37 now moves the carriage 31 from the maximum overtravel position to the end-of-stroke-position, with return to idling of the slide 127. As a result, the clutch 124 opens, disconnecting the roller 123 from the motor 83 and preventing the picking of other sheets. The spring 182 brings the storing lever 174 back against the profile 172 with the tab 173 in engagement with the recess 179 that is facing it.

The retracting sub-stage includes inversion of the direction of motion of the motor 83 counter-clockwise (CCW). The pinion 151 urges the plate 156 counter-clockwise in FIG. 3, but this rotation is prevented by the stopping of the lever 174 on the recess 179 and the kinematic linkage 152 remains in operation.

The motor rollers 56 and 57 rotate counter-clockwise, still at high speed (600 pps) and drive backward (BW) the sheet 26 towards the rear of the printer. The deflector 133 (FIGS. 1 and 3) deflects the sheet upwards on to the plate 131, with a partial traversing of the slot 129, until when the front edge of the sheet causes the direct sensor 60 to switch over.

The electronic unit 37 now gives rise to the positioning sub-stage with the inversion of the direction of motion of the motor 83 counter-clockwise (CW), at low switching speed, for example 200 pps. The kinematic linkage 152 remains in operation and the motor rollers 56 and 57 rotate counter-clockwise, driving the sheet 26 forward (FW) towards the front of the printer, until the front edge of the sheet moves the appendage 62, causing the controlled sensor 61 to switch.

The electronic unit 37 now de-activates the paper feeding motor 83 and activates the transport motor 74, moving the carriage 31 from the end-of-stroke-position to an intermediate overtravel position to the right of the blade 93. Through the appendage 135 and the tab 128, the slide 127 is moved by about 3 mm to the right, not enough to close the clutch 124, but sufficient to have the tab 173 of the storing lever 174 disengage from the recess 179, causing the plate 156 to be servo dependent on the direction of rotation of the motor 83.

The motor 83 is activated counter-clockwise again in FIG. 3 at low switching speed for silent operation. The plate 156 now meshes the worm screw 167 with the helical wheel 168 by activating the kinematic linkage 153 for counter-clockwise rotation, at high resolution of the motor rollers 56 and 57.

Engagement between the worm screw 167 and the helical wheel 168 is maintained by the action exerted by the pinion 151. The carriage 31 can move freely and the meshing between the worm screw and the tooth wheel is vibration-free thanks to the concomitant resistances due to the friction of the spring 171 on the axis 169 and the friction of the tab 173 on the sector 181.

The electronic unit 37 can start up the printing cycle, at the highest switching speed of the motor 83, for instance at 800 pps, with micrometric feeding of the sheet 26 in association with the transversal movement of the carriage 31 for printing of the stored picture.

Printing may be performed on cards without edges, due to the absence of substantial folds and the movement of the sheet 26 is guaranteed by the rollers arranged in front of and behind the printing area 41 and by the tooth disks 68 which contrast the weight of the part of the sheet emerging from the aperture 47. Ink escaping to the sides and at the front and rear ends of the sheet ends up in the space between the plates 49 and 51 and is absorbed by the layer 52.

When printing is finished, the electronic unit 37 starts the expulsion step by activating the transport motor 74 and moving the carriage 31 to the end-of-stroke-position. The direction of the motor 83 is again inverted for a rotation of the pinion 151 clockwise (FW) in FIG. 3. The plate 156 rotates in the same direction, bringing the intermediate tooth wheel 161 into meshing with the flat tooth wheel 162.

The kinematic linkage 152 is thus activated for a rotation again counter-clockwise, but at high speed, of the motor rollers 56 and 57. With the slide 127 motionless, the tab 173 of the lever 174 in turn goes to mesh with the recess 176 of the profile 172.

The motor rollers 57 continue to move the printed sheet through the aperture 47 by an amount sufficient to completely disengage the sheet and expel it from the aperture 47.

Naturally, without prejudice to the principle of the invention, the embodiments and the details of construction may be abundantly varied with respect to what has been described and illustrated purely by way of non-restrictive example, without departing from the scope of this invention.

What is claimed is:

1. Paper feeding device for dot printers, for example for an ink jet photographic printer, said paper feeding device comprising:

a paper feeding motor, a picking mechanism including a picking roller motorized by the paper feeding motor, the picking roller adapted to pick a sheet of paper from a stack and move the paper in a picking direction along a picking path, at least one motor roller located downstream of the picking roller along the picking direction, and motorized by the paper feeding motor, the motor roller adapted to retract the sheet in a retraction direction opposite the picking direction, the motor roller further adapted to move the sheet through the printer in a printing direction consistent with the picking direction, a deflector adapted to contact the sheet when the motor roller retracts the sheet in the retraction direction, the deflector adapted to deflect the sheet onto an alternative path to the picking path, a changeover mechanism arranged downstream of said paper feeding motor and suitable for actuation in response to predetermined operating conditions of the printer to operate the picking roller to move the sheet at high speed during movement in the picking direction, to operate the at least one motor roller to move the sheet at high speed during movement in the retraction direction, and to operate the at least one motor roller to move the sheet at low speed during movement of the paper in the printing direction.

2. Device according to claim 1 wherein the at least one motor roller is further adapted to move the sheet in the printing direction to position the sheet for printing after retracting the sheet in the retraction direction.

3. Device according to claim 1, wherein said changeover mechanism is adapted to move the sheet at high speed after printing in the direction of printing to eject the sheet from the printer.

4. Paper feeding device for dot printers, for example for a compact, ink jet photographic printer, comprising:

a paper feeding motor, a changeover mechanism arranged downstream of said paper feeding motor and suitable for actuation in response to predetermined operating conditions of the printer to move a sheet to be printed at high speed in preparation for printing and at low speed during printing, and an actuating member adapted to operate the changeover mechanism at high speed when the paper feeding motor rotates in a first direction, the changeover mechanism further adapted to switch the changeover mechanism to low speed when the paper feeding motor rotates in a second direction opposite to the first direction, wherein said actuating member is fulcrum-mounted on the axis of the feeding motor and is suitable for assuming angular positions associated with a first configuration for movement of the sheet at high speed and with a second configuration for movement of the sheet at low speed.

5. Paper feeding device for dot printers, for example for a compact, ink jet photographic printer, comprising:

a paper feeding motor, a changeover mechanism arranged downstream of said paper feeding motor and suitable for actuation in response to predetermined operating conditions of the printer to move a sheet to be printed at high speed in preparation for printing and at low speed during printing, an actuating member adapted to operate the changeover mechanism at high speed when the paper feeding motor rotates in a first direction, the changeover mechanism further adapted to switch the changeover mechanism to low speed when the paper feeding motor rotates in a second direction opposite to the first direction, a blocking group for blocking the position of the actuating member and overriding servo dependency on the direction of rotation of the paper feeding motor, and a control group operable to de-activate said blocking group.

6. Device according to claim 5 wherein the printer comprises a carriage for a printhead movable along a printing area, and said control group is servo dependent on the carriage for re-establishing servo control of the actuating member when the carriage is in a working position external to the printing area.

7. Device according to claim 6, wherein the paper feeding device is applied on an ink jet printer comprising a cleaning station in an end-of-stroke-position, said working position being adjacent to said cleaning station.

8. Device according to claim 5, wherein said blocking group comprises storing elements for storing a setting condition of said blocking group.

9. Paper feeding device for dot printers, for example for an ink jet photographic printer, said paper feeding device comprising:

a paper feeding motor, a picking mechanism including a picking roller motorized by the paper feeding motor, the picking roller adapted to pick a sheet of paper from a stack and move the paper in a picking direction along a picking path, at least one motor roller located downstream of the picking roller along the picking direction, and motorized by the paper feeding motor, the motor roller adapted to retract the sheet in a retraction direction opposite the picking direction along an alternative path to the picking path, the motor roller further adapted to move the sheet through the printer in a printing direction consistent with the picking direction, a changeover mechanism arranged downstream of said paper feeding motor and suitable for actuation in response to predetermined operating conditions of the printer to operate the picking roller to move the sheet at high speed during movement in the picking direction, to operate the at least one motor roller to move the sheet at high speed during movement in the retraction direction, and to operate the at least one motor roller to move the sheet at low speed during movement of the paper in the printing direction, and a passage sensor switchable by a sheet in an end-of-picking position, wherein movement of the motor roller in the retraction direction starts with a switching of the passage sensor and terminates with another switching of the passage sensor upon the sheet passing through the end-of-picking position.

10. Device according to claim 1, further comprising a blocking group, wherein activation of the blocking group causes inversion of the direction of motion of the paper feeding motor to position the sheet for printing.

11. Paper feeding device for dot printers, for example for an ink jet photographic printer, said paper feeding device comprising:

a paper feeding motor, a picking mechanism including a picking roller motorized by the paper feeding motor, the picking roller adapted to pick a sheet of paper from a stack and move the paper in a picking direction along a picking path, at least one motor roller located downstream of the picking roller along the picking direction, and motorized by the paper feeding motor, the motor roller adapted to retract the sheet in a retraction direction opposite the picking direction along an alternative path to the picking path, the motor roller further adapted to move the sheet through the printer in a printing direction consistent with the picking direction, and a changeover mechanism arranged downstream of said paper feeding motor and suitable for actuation in response to predetermined operating conditions of the printer to operate the picking roller to move the sheet at high speed during movement in the picking direction, to operate the at least one motor roller to move the sheet at high speed during movement in the retraction direction, and to operate the at least one motor roller to move the sheet at low speed during movement of the paper in the printing direction, a blocking group, wherein activation of the blocking group causes inversion of the direction of motion of the paper feeding motor to position the sheet for printing, and a reference sensor switchable for a reference position of the sheet with respect to the printing area, wherein commutation of the reference sensor in the sheet reference position terminates motion of the paper feeding motor to position the sheet for printing.

12. Device according to claim 4 further comprising a blocking group including a stopping member for blocking said actuating member in the first configuration, and a removing element operable to deactivate the stopping member.

13. Device according to claim 1, wherein the picking mechanism further includes a clutch suitable for being connected with the paper feeding motor.

14. Device according to claim 1, further comprising a worm screw and helical wheel coupling actuatable by the changeover mechanism for low speed movement of the sheet to be printed.

15. Paper feeding device for dot printers, for example for an ink jet photographic printer, comprising:

a paper feeding motor, a first kinematic linkage associated with said feeding motor for producing high speed movements of a sheet during picking of the sheet from a stack and during preparation for printing, a second kinematic linkage associated with said feeding motor and having a transmission ratio different from that of said first kinematic linkage for producing low speed sheet movements during printing, and an actuating member for selectively operating the first kinematic linkage or the second kinematic linkage, wherein, for a given direction of rotation of said motor, the second kinematic linkage imparts movement to the sheet in a direction opposite to that of the first kinematic linkage.

16. Paper feeding device for dot printers, for example for an ink jet photographic printer, comprising:

a paper feeding motor, a first kinematic linkage associated with said feeding motor for producing high speed movements of a sheet during picking of the sheet from a stack and during preparation for printing, a second kinematic linkage associated with said feeding motor and having a transmission ratio different from that of said first kinematic linkage for producing low speed sheet movements during printing, and an actuating member for selectively operating the first kinematic linkage or the second kinematic linkage, wherein, for a given direction of rotation of said motor, the second kinematic linkage imparts movement to the sheet in a direction opposite to that of the first kinematic linkage, and a pinion connected to the paper feeding motor, wherein said actuating member comprises a plate supporting first and second intermediate tooth wheels meshing with the pinion and wherein said plate is adapted to be driven by said pinion in the direction of rotation of the feeding motor for rotatably connecting the first or second intermediate tooth wheel with the first or second kinematic linkage.

17. Device according to claim 16 further comprising a blocking group that is suitable for being actuated to block said plate in a predetermined configuration allowing operativity of the first kinematic linkage for two directions of rotation of the motor.

18. Paper feeding device for dot printers, for example for an ink jet photographic printer comprising:

a carriage for a printhead movable along a printing area, a paper feeding motor, a picking mechanism for picking from a pack and feeding one by one the sheets to be printed, a clutch for operatively connecting said picking mechanism with the paper feeding motor, a first kinematic linkage associated with said feeding motor for producing high speed movements of the sheets;

a second kinematic linkage associated with said feeding motor for producing low speed movements of the sheets; and a control group adapted to command the clutch and the first and second linkages based on different positions of the carriage outside the printing area, wherein the control group is adapted to engage the first kinematic linkage or the second kinematic linkage based on the position of the carriage.

19. Paper feeding device for dot printers, for example for an ink jet, photographic printer, said feeding device comprising:

a paper feeding motor including a pinion;

a kinematic linkage comprising a worm screw that is suitable for being actuated by the paper feeding motor and a helical wheel for moving a sheet at low speed in association with printing;

a support for said worm screw, said support being movable between a first position where the worm screw is in engagement with the helical wheel, and a second position where the worm screw is disengaged from the helical wheel;

an intermediate tooth wheel that rotates on said support integral with rotation of said worm screw, the intermediate tooth wheel meshing with the pinion;

wherein the support is adapted to be driven to the first position by the pinion upon a predetermined direction of rotation of the motor to engage the worm screw with the helical wheel.

20. Device according to claim 19, further comprising friction means comprising the worm screw and the intermediate tooth wheel, the friction means having an anti-vibration function in the meshing between said worm screw and said helical wheel.

* * * * *